US009578967B2

(12) United States Patent
Besler et al.

(10) Patent No.: US 9,578,967 B2
(45) Date of Patent: Feb. 28, 2017

(54) PIECE OF ROTARY SEATING FURNITURE

(71) Applicants: Boris Besler, Guetersloh (DE); Andreas Hortig, Halle (DE)

(72) Inventors: Boris Besler, Guetersloh (DE); Andreas Hortig, Halle (DE)

(73) Assignee: KINTEC-SOLUTION GMBH, Rietberg (DE)

( * ) Notice: Subject to any disclaimer, the term of this patent is extended or adjusted under 35 U.S.C. 154(b) by 16 days.

(21) Appl. No.: 14/643,079

(22) Filed: Mar. 10, 2015

(65) Prior Publication Data

US 2015/0257537 A1 Sep. 17, 2015

(30) Foreign Application Priority Data

Mar. 11, 2014 (DE) ..... 10 2014 204 401

(51) Int. Cl.
*A47C 3/18* (2006.01)
*A61G 5/14* (2006.01)

(52) U.S. Cl.
CPC ..... *A47C 3/185* (2013.01); *A47C 3/18* (2013.01); *A61G 5/14* (2013.01)

(58) Field of Classification Search
CPC ..... A47C 3/185; A47C 3/18
USPC ..... 297/344.21, 344.22
See application file for complete search history.

(56) References Cited

U.S. PATENT DOCUMENTS 1,578,784 A * 3/1926 Walton ..... A47C 3/18 248/417
1,895,226 A * 1/1933 Kupski ..... A47C 3/18 248/417
2,755,842 A * 7/1956 Caramelli ..... A47C 3/18 248/416
3,223,376 A * 12/1965 Ciuffini ..... A47C 3/18 248/417
3,837,611 A * 9/1974 Rhoades ..... A47C 3/185 248/417
5,265,838 A * 11/1993 Kjellman ..... A47C 3/185 248/289.31
5,806,828 A * 9/1998 Rothe ..... A47C 3/18 248/631

(Continued)

FOREIGN PATENT DOCUMENTS

DE 25 30 944 A1 1/1977
DE 80 17 198 U1 2/1981

(Continued)

OTHER PUBLICATIONS

German Office Action issued in Appln. No. 10 2014 204 401.4 dated May 5, 2015 ( 5 pages).

(Continued)

*Primary Examiner* — Timothy J Brindley

(74) *Attorney, Agent, or Firm* — Flynn, Thiel, Boutell & Tanis, P.C.

(57) ABSTRACT

A piece of seating furniture having a base and a seat unit, wherein the base and the seat unit have provided between them a pivot bearing including a base-side bearing device and a seat-unit-side bearing device, via which the seat unit is rotatable about a vertical axis in relation to the base, and the pivot bearing has a switchable blocking device, via which the rotary movement capability of the bearing devices in relation to one another can be blocked.

11 Claims, 5 Drawing Sheets

(56) References Cited

U.S. PATENT DOCUMENTS

| | | | | |
|---|---|---|---|---|
| 6,315,262 | B1 * | 11/2001 | Hur | A47C 3/18 248/162.1 |
| 2014/0292053 | A1 * | 10/2014 | Chou | A47C 3/185 297/344.21 |
| 2014/0312725 | A1 | 10/2014 | Oberndorfer | |
| 2015/0034790 | A1 * | 2/2015 | Tsuboi | A47C 3/185 248/404 |

FOREIGN PATENT DOCUMENTS

| | | | |
|---|---|---|---|
| DE | 10 2012 219 113 | A1 | 5/2013 |
| GB | 2 430 009 | A | 3/2007 |

OTHER PUBLICATIONS

Form PCT/ISA/210 issued in Appln. No. PCT/EP2015/054860 dated May 8, 2015 with English translation of Categories of Documents Cited (4 pages).
Form PCT/ISA 220 issued in Appln. No. PCT/EP2015/054860 dated May 8, 2015 (1 page).
Form PCT/ISA/237 issued in Appln. No. PCT/EP2015/054860 dated May 8, 2015 (6 pages).

* cited by examiner

PIECE OF ROTARY SEATING FURNITURE

CROSS-REFERENCE TO RELATED APPLICATIONS

This application claims the priority of German Application No. 10 2014 204 401.4, filed on Mar. 11, 2014, the disclosure of which is hereby incorporated by reference in its entirety into this application.

FIELD OF APPLICATION AND PRIOR ART

The invention relates to a piece of seating furniture having a base and a seat unit, wherein the base and the seat unit have provided between them a pivot bearing comprising a base-side bearing device and a seat-unit-side bearing device, by means of which the seat unit can be rotated about a vertical axis in relation to the base. The pivot bearing here has a switchable blocking device, by means of which the rotary movement capability of the bearing devices in relation to one another can be blocked.

The invention also additionally relates to a fitting for such a piece of seating furniture.

Pieces of seating furniture of the type in question are known from the prior art. These are pieces of seating furniture of which the seat unit can be rotated, in principle, in relation to a base, it being possible for the base to be both a foot provided for positioning at a fixed location and a base portion provided with rollers. The latter scenario is generally known in particular in respect of pieces of seating furniture for the office. The rotary movement capability of the seat unit makes it possible for the seated person to rotate the seat unit, and thus assume a sitting position of changed orientation, without rotating the base.

The pivot bearing, which is provided for this purpose between the base and the seat unit, is provided, in the case of pieces of seating furniture of the type in question, with a blocking device which couples the base and the seat unit to one another, in a given rotary position relative to one another, such that rotary movement is no longer possible or is made much more difficult.

The aforementioned blocking capability is expedient in particular when the piece of seating furniture is one with a standing-up aid. Such a standing-up aid allows the seat unit to be raised in particular by electric motor, and this makes it easier to stand up from the piece of seating furniture. Rotary movement of the seat unit is generally not desired during the standing-up phase. The blocking action prevents the situation, during the standing-up phase, where the person ends up falling on account of the rotary movement capability of the seat unit.

Known configurations for creating a switchable blocking device involve comparatively high outlay. Thus, it has been proposed for example to create such a blocking device by means of an additional electric motor which can displace a locking member into a position in which said locking member couples the seat unit and the base to one another in a form-fitting manner.

This and other known solutions, however, have continually exhibited the disadvantage that they involve fairly expensive additional components and, in some cases, do not provide the desired level of reliability.

OBJECT AND SOLUTION

It is therefore an object of the invention for a piece of seating furniture of the type in question and/or a fitting for such a piece of seating furniture to be developed to the extent where the switchable blocking device is cost-effective and reliable.

This is achieved according to the invention in that the blocking device has a blocking surface, a torsion spring, which encloses said blocking surface, and a switching device. The aforementioned blocking surface is provided on a first of the two bearing devices. The aforementioned torsion spring wraps around said blocking surface and is fastened on a second bearing device and is such that it has a variable internal diameter in dependence on the stressing state. The switching device is coupled to the torsion spring such that the torsion spring can be optionally subjected to stressing or relieved of stressing. The torsion spring and the blocking surface are coordinated with one another such that the torsion spring, either in a stressed/compressed or relieved-of-stressing/drawn-together state, butts against the blocking surface and, thus, prevents rotary movement between the bearing devices.

The configuration of the blocking device according to the invention thus provides that the blocking device has an encircling blocking surface, on which the aforementioned torsion spring can be positioned with clamping action and from which the torsion spring can be lifted off, the blocking surface being freed in the process. The blocking surface here is a preferably cylindrical surface oriented in the direction of the vertical axis. The torsion spring encloses said blocking surface one or more times. It is such that, in the tight relatively stressed or relieved-of-stressing state, it butts with clamping action against the blocking surface, and therefore cannot be moved in relation to the same, and, in the respectively other, wide more relieved-of-stressing or stressed state, it exerts only a relatively small amount of force, if any at all, on the blocking surface and thus allows the rotary movement.

The switching device may be, in principle, an electrically operated switching device, which widens or draws together the torsion spring. However, the switching device is preferably a mechanical component, which establishes a mechanical coupling to other sub-components of the piece of seating furniture and thus establishes the freed and the blocked states of the blocking device in reaction to the movement of said other parts.

The torsion spring used is such that its internal diameter depends on its stressing state. This is achieved in particular by a torsion spring having in particular helically arranged windings. The cross section through said windings may be circular. Depending on the specific configuration, however, a square or otherwise rectangular shape may be advantageous, since such shaping gives rise to easier rotationally secured clamping-in action and provides for surface contact between the inside of the windings and the blocking surface.

The end of the windings is formed preferably by two torque-inducing portions, of which the relative position in the circumferential direction determines the stressing state. The ends of said windings may be directed in particular radially or obliquely outwards, as is customary in the case of leg springs. In respect of low costs for the blocking device, the use of commercially available leg springs is advantageous.

A configuration which is conceivable in principle is one in which, in order to modify the stressing state in the torsion spring, the two torque-inducing portions of the same torsion spring are displaced away from one another, or towards one another, relative to the second bearing device. If the torsion spring, however, has no spring portion fixed to the second bearing device, then disruption-free operation is more difficult to ensure. It is therefore advantageous if one of the torque-inducing portions is fastened on the second bearing device such that it cannot be moved in the circumferential direction. This makes it possible to achieve movement of the torque-inducing portions relative to one another in that that torque-inducing portion of the torsion spring which is not fastened on the second bearing device such that it cannot be moved is displaced in the circumferential direction. Skewing of the spring is avoided by the spring being clamped in firmly on one side.

As far as the configuration and number of the preferably metallic torsion springs are concerned, a minimum value has the one torsion spring, or the plurality of torsion springs together, wrapping around the blocking surface over an angle of at least approximately 360° (±15%). In the blocking state, the blocking surface is thus clamped firmly at least more or less all the way around by the torsion spring or the torsion springs. Particularly advantageous configurations are considered to be those in which the torsion spring wraps, or the plurality of torsion springs wrap, around the blocking surface over an angle of approximately 1080° (±15%) or 1800° (±15%). These are therefore overall angles of wrap which provide for the blocking surface to have the spring wrapped around it approximately three times or approximately five times.

Depending on the configuration of the torsion spring and the attachment of the torsion spring, the torsion-spring stressing provided for establishing or releasing the blocking state also results in a circumferentially acting torque, which is not desired. It is therefore advantageous if use is made of an even number of torsion springs, in particular two torsion springs, which, when simultaneously subjected to stressing or simultaneously relieved of stressing, are subjected to stressing or relieved of stressing in opposite directions, as seen in relation to the circumferential direction, so that their circumferentially acting torque is compensated for in each case.

In respect of the aforementioned angles of wrap, it is particularly advantageous if said two torsion springs wrap around the blocking surface in each case over an angle of approximately 540° (±15°) or of approximately 900° (±15°), that is to say in each case approximately one and a half times or two and a half times.

If use is made of just one torsion spring, then there is the risk of it skewing, in particular if the torque-inducing portions of said torsion spring are offset in relation to one another in an axial direction. In such a case, it is therefore advantageous if plastic sleeves or the like are provided above and beneath the torsion spring, said plastic sleeves fixing the torsion spring axially in position and preventing the torsion spring from tilting.

The switching device preferably has a switching carriage, which can be moved axially with guidance by a guide along the first or second bearing device. Said switching carriage is operatively coupled here to the torsion spring or the torsion springs such that the axial displacement of the switching carriage gives rise to the torsion spring being subjected to stressing or relieved of stressing and thus to the blocking device being blocked or released.

In the simplest case, the switching carriage can be mounted on the first or second bearing device by a slot with a slider, in particular in the form of screws, arranged therein. The displacement of the switching carriage can take place in particular indirectly by displacement of other sub-components of the piece of seating furniture. In principle, however, it is also possible for the switching carriage to be driven directly by electric means.

The interaction between the switching carriage, on the one hand, and the at least one torsion spring, on the other hand, takes place preferably by at least one switching slope being arranged directly on the switching carriage, a torque-inducing portion of the torsion spring, said portion sliding on said switching slope, being displaced in the circumferential direction by the axial displacement of said switching slope. In the case of a torsion spring of which the two torque-inducing portions can be moved in the circumferential direction in relation to the second bearing device, it is also possible for the switching carriage to have two switching slopes. A switching carriage having two switching slopes is also advantageous when use is made of more than one torsion spring, so that a respective torque-inducing portion of a plurality of torsion springs together can be deflected by the switching carriage. If the switching carriage has a plurality of switching slopes, then these are offset preferably axially in relation to one another, so that there is no need for the torque-inducing portions of the plurality of torsion springs to be positioned at the same height.

Instead of the switching carriage acting directly on one or more torque-inducing portions, it is also possible for the switching carriage to act on an intermediate member which can be moved relative to the switching carriage and may be provided, for example, in a pivotable manner on the second bearing device. Said intermediate member, for its part, acts on one or more torque-inducing portions of the torsion spring or torsion springs, so that said spring or springs is or are deflected in the circumferential direction in reaction to the displacement of the intermediate member.

So that the switching carriage or the intermediate member, during the force activation of the torque-inducing portion, displaces the latter in the desired direction, in particular in an essentially circumferential direction, it is advantageous if the torque-inducing portion which can be moved in relation to the second bearing device can be moved with guidance. This can be achieved for example by a slot, through which the torque-inducing portion passes. Guidance, however, is not imperative, since even the wraparound form of the spring usually ensures a sufficient level of axial positional stability for the torque-inducing portions.

It is further advantageous to provide a restoring spring, by means of which the switching carriage is forced permanently in the direction of one of its end positions. It is particularly advantageous if said restoring spring, rather than being designed in the form of a separate spring element, is formed by the one or more torsion springs. It is thus possible, for example in the case of suitable oblique positioning of the aforementioned switching slope, while avoiding the self-locking region, to achieve the situation where said switching slope, on the one hand, serves in the manner described to transfer the axial movement of the switching carriage in a circumferential direction of one or more torque-inducing portions. At the same time, however, it is also possible for the torque-inducing portions to exert the restoring force on the switching carriage, in that the torque-inducing portions, which act with force activation in the circumferential direction, exert an axial force on the switching carriage as a result of the switching slope being redirected.

Instead of a switching carriage which can be displaced in translatory fashion, a further configuration of the switching device provides a switching lever, which is fitted in a pivotable manner on the first or the second bearing device and which is operatively coupled to the torsion spring such that a pivoting movement of the switching lever gives rise to the torsion spring being subjected to stressing or relieved of stressing and thus to the blocking device being blocked or released, wherein preferably the switching lever is connected to a torque-inducing portion of the torsion spring, so that the latter can be displaced in the circumferential direction by a pivoting movement of the switching lever.

If the blocking device has two torsion springs, a switching lever is provided preferably for each torsion spring. The torsion spring or springs is or are provided preferably on the seat-side bearing device and can be pivoted in each case about a horizontal pivot axis. Preferably an arm of the at least one switching lever is connected to a torque-inducing portion of a torsion spring, so that this is moved in the circumferential direction when the switching lever is pivoted. The pivoting movement of the switching lever thus results in the desired blocking or freeing action.

As already mentioned, the operation of switching the blocking device can be realized in various ways.

A particularly advantageous configuration provides that the piece of seating furniture is one with a standing-up-aiding function, by means of which the seat surface can be raised in order to facilitate standing from the sitting position. In the case of such a piece of seating furniture, the blocking device may be operatively coupled to the standing-up-aiding function such that it assumes its blocked state when the standing-up-aiding function is actuated. The standing-up aid may be of electromotive design, in a manner which is known per se. In principle, however, a mechanical, for example spring-operated, standing-up-aiding function is also conceivable. In the case of the blocking device being coupled to the standing-up aid, it is particularly advantageous if a fitting portion which is moved during the activation of the standing-up aid forces, or allows, displacement of the switching carriage or of the switching lever and thus gives rise to the blocked or freed state of the blocking device.

Coupling the standing-up-aiding function to the blocking device is expedient in particular since rotatability of the seat surface precludes easy standing up. It is therefore expedient to establish the blocked state when the standing-up aid is activated.

Another possible configuration for controlling the blocking device provides, for this purpose, an operating lever for manual actuation, which is preferably likewise such that it can move the axially displaceable switching carriage or the pivotable switching lever. It is possible for such an operating lever, in the manner generally known in respect of pieces of seating furniture for the office, to be provided beneath the seat surface and either to allow a sustained blocking and freeing action or, proceeding from a normally blocked state, to permit a temporary freeing action by displacement of the operating lever.

The first and second bearing devices are distributed between the base and the seat surface, in principle, as desired. The blocking surface may thus be rotationally fixed either in relation to the seat surface or in relation to the base, whereas the torsion spring is at a fixed location in relation to the respectively other bearing device. An advantageous configuration, however, is one in which the blocking surface and the first bearing device are provided on the base side and the torsion spring and the second bearing device are provided on the seat-surface side. This makes it possible for seat-side actuators, such as the aforementioned operating lever, and also the standing-up-aiding function to be more readily coupled for switching action to the torsion spring.

In addition to the piece of seating furniture as a whole, the invention also relates to a fitting for such a piece of seating furniture.

BRIEF DESCRIPTION OF THE DRAWINGS

Further aspects and advantages of the invention can be gathered from the claims and from the following description of a preferred exemplary embodiment of the invention, which will be explained with reference to the figures, in which:

DETAILED DESCRIPTION OF THE EXEMPLARY EMBODIMENTS

Figure 1A:
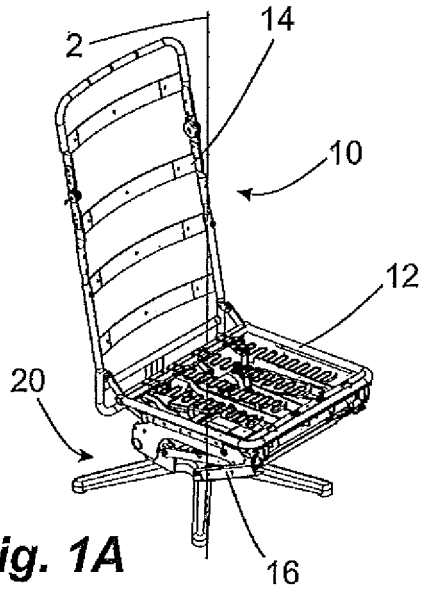
FIGS. 1A-1C show a piece of seating furniture according to the invention in a perspective view, in a view from the rear and in a view from the front.
Figure 1B:
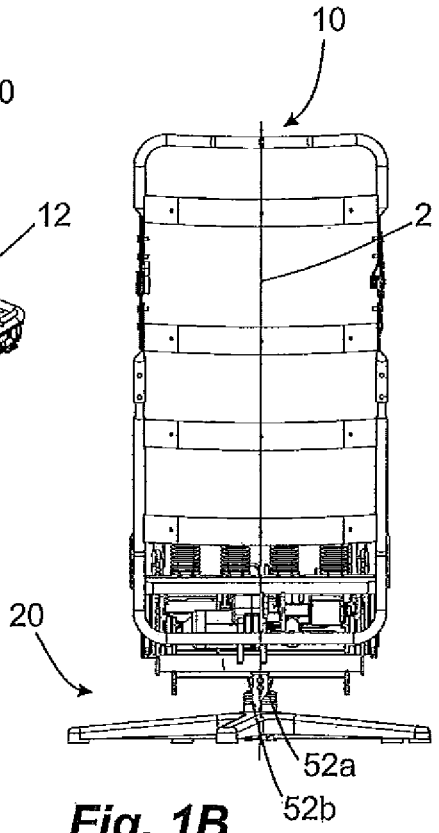
Figure 1C:
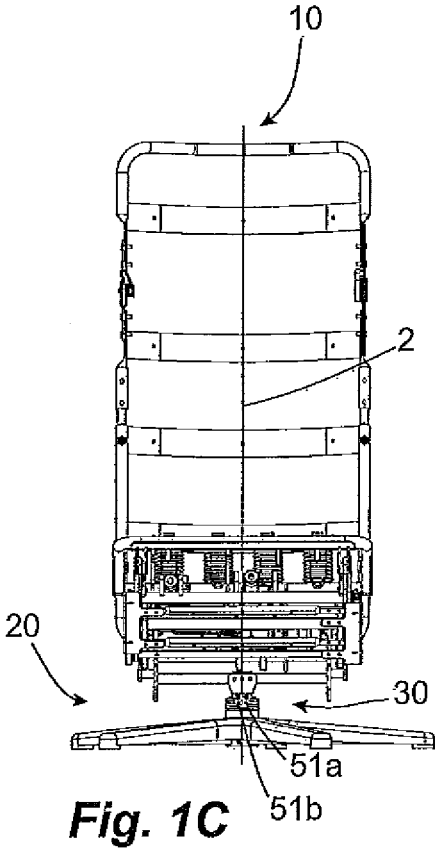

FIGS. 1*a* to 1*c* show a piece of seating furniture according to the invention in the manner of a chair. This piece of seating furniture has a seat unit 10, in this case comprising, in addition to a seat surface 12, which is illustrated in the non-upholstered state, also a backrest 14 and a legrest 16. The seat unit 10 can be rotated as a whole about a vertical axis 2 in relation to a base 20. The base 20 is provided for positioning the piece of seating furniture at a fixed location, but could also be provided, in the manner of office chairs, with rollers, in order to allow the chair to be displaced straightforwardly as a whole.

The rotatability of the seat unit is achieved via a pivot bearing 30, which is arranged directly above the base 20.

Figure 2:
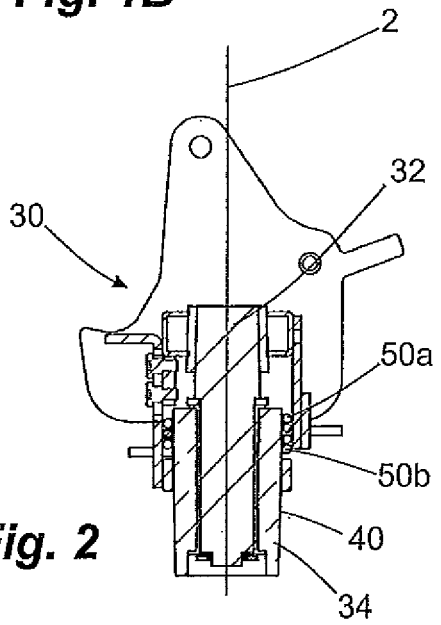
FIG. 2 shows the pivot bearing of the piece of seating furniture according to FIG. 1 together with a blocking device.

Said pivot bearing can be seen in section in FIG. 2. It comprises in particular an inner axial portion 32, which is rotationally fixed in relation to the seat unit 12, and a bearing sleeve 34, which accommodates the axial portion 32 and is a fixed constituent part of the base 20.

The rotatability which said pivot bearing having the components 32, 34 provides for the seat unit 10 in relation to the base 20 can be blocked, in the case of a piece of seating furniture according to the invention, such that rotation can be prevented, or at least made considerably more difficult, in certain cases.

Figure 3A:
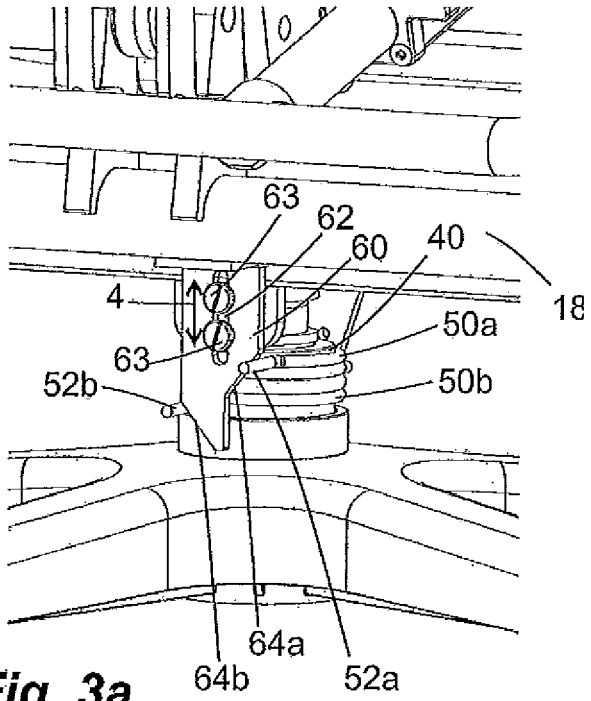
FIGS. 3*a* to 3*c* show the blocking device in the freed state.
Figure 3B:
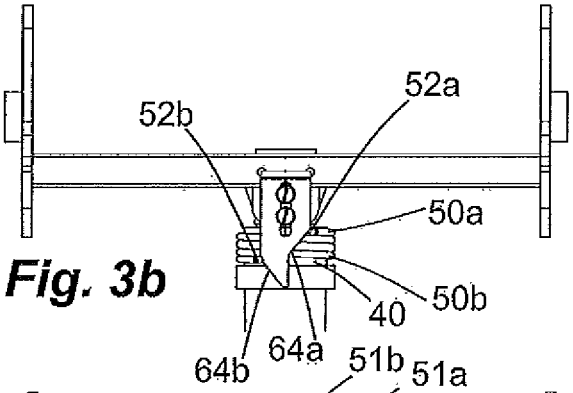
Figure 3C:
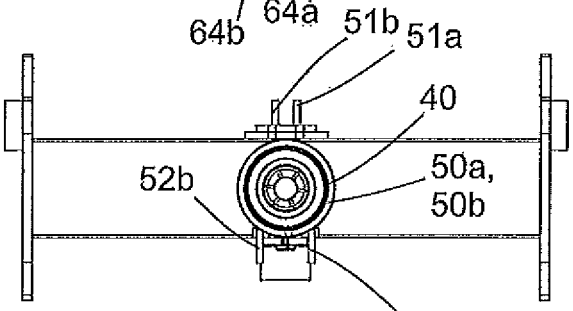

The main components of the blocking device provided for this purpose, with reference to FIGS. 2, 3 and 4, are primarily a blocking surface 40, which is formed by the outer surface of the bearing sleeve 34, and two torsion springs 50*a*, 50*b*, each designed in the manner of leg springs. The two leg springs 50*a*, 50*b* each have one leg 51*a*, 51*b* fitted on the seat unit 12 at a fixed location as seen in relation to a circumferential direction about the axis of rotation 2, whereas the respectively opposite legs 52*a*, 52*b* can be moved in principle in relation to the circumferential direction. A circumferentially directed movement of the legs 52*a*, 52*b* results in the torsion springs 50*a*, 50*b* being subjected to stressing or relieved of stressing.

The torsion springs 50*a*, 50*b* enclose the blocking surface 40 by way of their in each case 1.5 windings (corresponding to approximately 540°). The torsion springs 50*a*, 50*b* here are coordinated with the diameter of the blocking surface 40 such that, in the absence of an external torque acting on the legs, the springs assume a relieved-of-stressing state, in which they are pressed onto the blocking surface 40. This constitutes the blocked state. In the absence, therefore, of any torque which acts to spread apart the legs 52*a*, 52*b*, the torsion springs 50*a*, 50*b* block a rotary movement of the seat unit 10 in relation to the base 20.

In order to achieve the freeing action, the displaceable legs 52*a*, 52*b* have to be spread apart from one another. A switching carriage 60 is provided for this purpose, and said carriage can be displaced in the axial direction depicted by the arrow 4. The switching carriage 60, for this purpose, is provided with a slot 62, through which project two screws 63 which have been screwed into the seat-side bearing device. The switching carriage 60 has two axially offset switching slopes 64*a*, 64*b*, which are inclined in opposite directions and against which the spring legs 52*a*, 52*b* butt. The switching slopes here have an angle of approximately 45° in relation to the vertical. Although other angles are also conceivable here, in principle, it is nevertheless advantageous if the switching slopes 64*a*, 64*b* are angled such that there is no self-locking taking place in either direction of action: it is desired for displacement of the switching carriage 60 to be able to spread apart the spring legs 52*a*, 52*b* and for the legs 52*a*, 52*b* to be able to initiate an axially acting force in the switching carriage 60, so that the latter can be restored.

FIGS. 3*a* and 3*b* show the freed state of the blocking device. This state is achieved when the switching carriage 60 is located in a lower end position, in which the legs 52*a*, 52*b* are arranged in each case in the region of the upper ends of the switching slopes 64*a*, 64*b*. The legs have thus been spread apart from one another. The windings of the springs 50*a*, 50*b* no longer butt with clamping action against the blocking surface 40. The lower end position of the switching carriage 60 is brought about by a transverse crossmember 18 of the seat unit 10, this acting on the switching carriage 60 from above and not allowing the switching carriage to yield upwards in the freed position of FIGS. 3*a* and 3*b*.

Figure 4A:
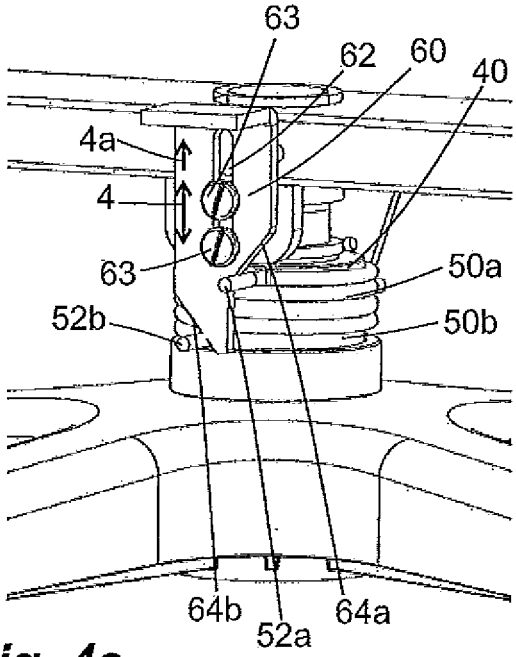
FIGS. 4*a* to 4*c* show the blocking device in the blocked state.
Figure 4B:
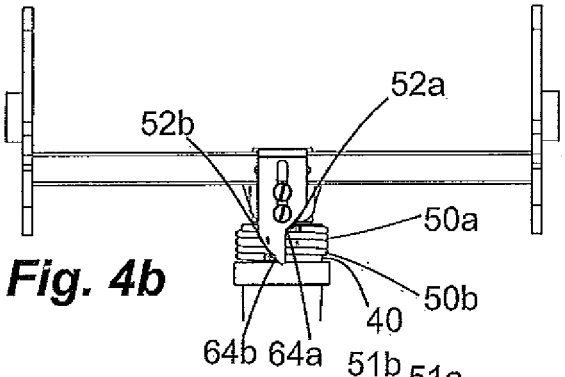
Figure 4C:
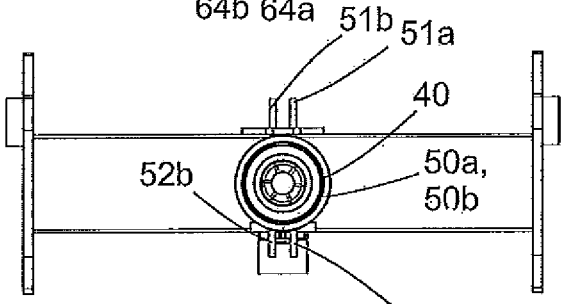

In the absence of this downwardly directed force activation of the switching carriage 60, the situation shown in FIGS. 4*a* to 4*c* is established. The switching carriage 60 is displaced upwards in the direction of the arrow 4*a*, since the legs 52*a*, 52*b* at the end of the torsion springs 50*a*, 50*b* attempt to assume their relatively relieved-of-stressing position shown in FIGS. 4*a* to 4*c*. Via the switching slopes 64*a*, 64*b*, the legs here push the switching carriage 60 upwards. In the state shown in FIGS. 4*a* to 4*c*, the windings of the torsion springs 50*a*, 50*b* are therefore tighter and butt with clamping action against the blocking surface 40. Rotary movement of the seat unit 10 in relation to the base 20, then, is possible only with great difficulty, if at all.

Figure 5A:
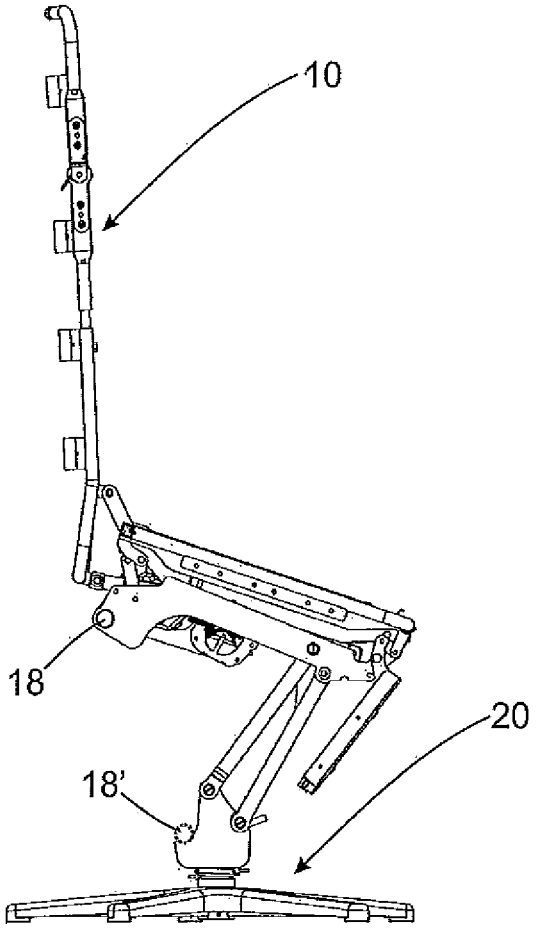
FIGS. 5A and 5B show the piece of seating furniture from FIGS. 1*a* to 1*c* with the standing-up aid activated.
Figure 5B:
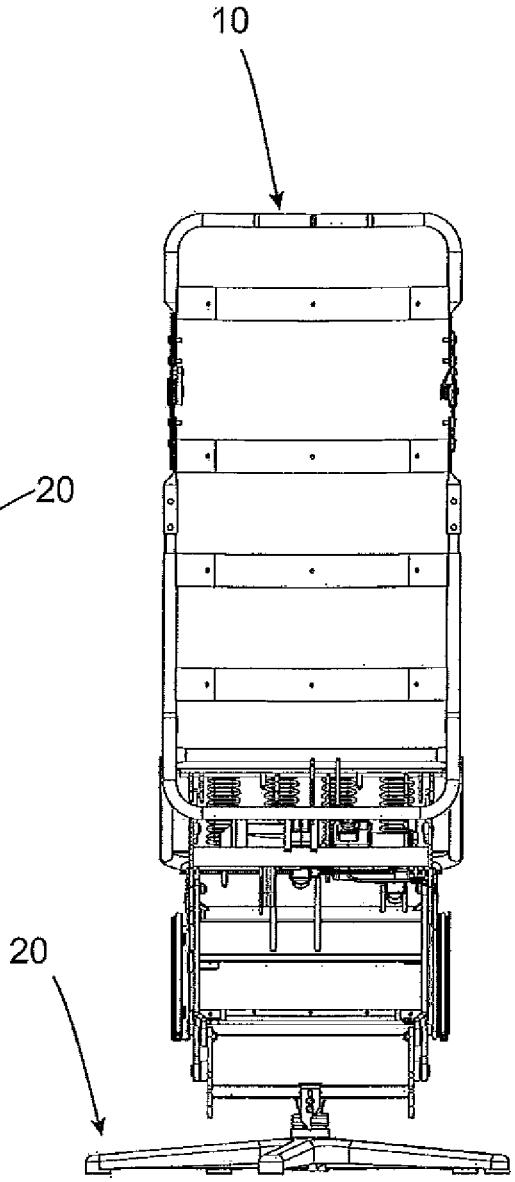

FIGS. 5*a* and 5*b* depict how the blocked state shown in FIGS. 4*a* to 4*c* is brought about. The figures show the piece of seating furniture with the standing-up aid activated. This standing-up aid can pivot a multiplicity of components of the seat unit 10 in the manner illustrated. These components also include the aforementioned transverse crossmember 18, which is raised out of its starting position 18', indicated by dashed lines in FIG. 5*a*, and thus loses contact with the switching carriage 60. Consequently, the latter yields upwards, in the manner already described, and establishes the blocked state of the blocking device. Activation of the standing-up-aiding function thus also gives rise as it were automatically, without any separate switching operation being required, to blocking of the blocking device.

Figure 6A:
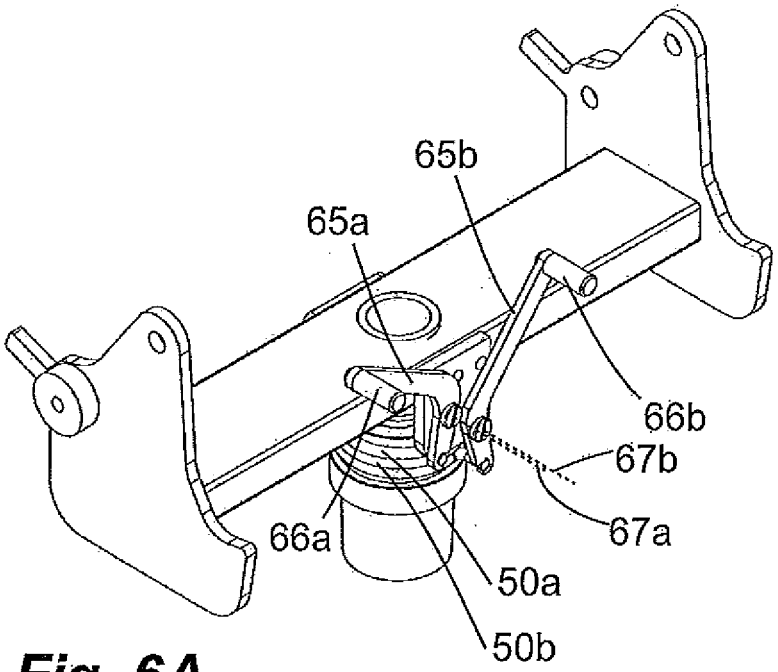
FIGS. 6A to 6B show an alternative form of blocking device.
Figure 6B:
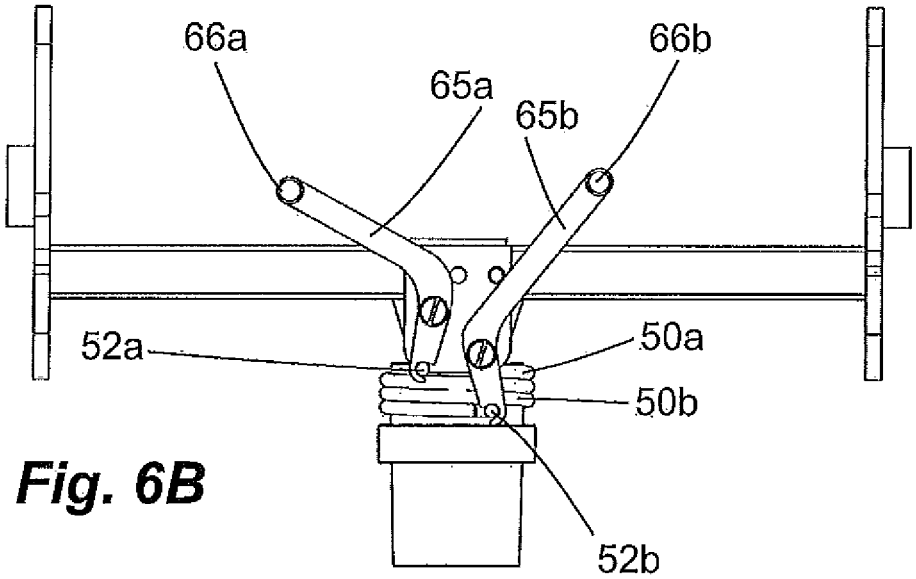

FIGS. 6*a* and 6*b* show an alternative form of blocking device. The latter, instead of the carriage 60 having the switching slopes 64*a*, 64*b*, has two switching levers 65*a*, 65*b*, which are fitted such that they can be pivoted about axes 67*a*, 67*b* in relation to the seat-unit-side bearing device 32. The spring legs 52*a*, 52*b* of the torsion springs 50*a*, 50*b*, said legs acting as torque-inducing portions, are secured at the respectively lower end of said switching levers 65*a*, 65*b*. The respectively upper end of the switching levers is provided with a coupling portion 66*a*, 66*b*, it being possible for the switching levers 65*a*, 65*b* to be pivoted by the force activation of said coupling portion.

In a manner similar to the switching carriage 66 described, the switching levers 65*a*, 65*b* are actuated via the transverse crossmember 18. The blocking device is released by virtue of the transverse crossmember 18 being lowered. If the transverse crossmember 18 is raised, then it is possible for the torsion springs 50*a*, 50*b*, with the switching levers 65*a*, 65*b* being pivoted at the same time, to resume their relatively relieved-of-stressing state, in which they butt against the blocking surface 40 and thus shift the blocking device into the blocked state.

The invention claimed is:

1. A piece of seating furniture having a base;

a seat unit; and a pivot bearing provided between the base and the seat unit, the pivot bearing comprising a base-side bearing device and a seat-unit-side bearing device, by which the seat unit can be rotated about a vertical axis in relation to the base;

the pivot bearing having a switchable blocking device, by which a rotary movement capability of the bearing devices in relation to one another can be blocked; and the blocking device comprising an encircling blocking surface on a first one of the bearing devices, at least one torsion spring which wraps around the encircling blocking surface and being fastened on a second one of the bearing devices and having an internal diameter which is variable in dependence on a stressing state of the at least one torsion spring, and a switching device by which the at least one torsion spring can be subjected to stressing and relieved of stressing;

wherein the at least one torsion spring, in a relieved-of-stressing state, butts against the blocking surface and thus prevents relative rotary movement between the bearing devices.

2. The piece of seating furniture according to claim 1, wherein the at least one torsion spring has two torque-inducing portions, of which a circumferentially directed relative movement can subject the at least one torsion spring to stressing and relieve the at least one torsion spring of stressing.

3. The piece of seating furniture according to claim 2, wherein one of the two torque-inducing portions is fastened on the second one of the bearing devices such that the second one of the bearing devices cannot be moved in a circumferential direction.

4. The piece of seating furniture according to claim 1, wherein the at least one torsion spring wraps around the blocking surface over an angle of at least approximately 360°.

5. The piece of seating furniture according to claim 1, wherein the switching device has a switching carriage, which can be moved axially with guidance along the first one or the second one of the bearing devices and which is operatively coupled to the at least one torsion spring such that an axial displacement of the switching carriage gives rise to the at least one torsion spring being subjected to stressing and thus to the blocking devices to being released.

6. The piece of seating furniture according to claim 5, further including a restoring spring, by which the switching carriage is forced permanently in a direction of an end position.

7. The piece of seating furniture according to claim 1, wherein the switching device has a switching lever, which is fitted in a pivotable manner in relation to the first one or the second one of the bearing devices and which is operatively coupled to the at least one torsion spring such that a pivoting movement of the switching lever gives rise to the at least one torsion spring being subjected to stressing and thus to the blocking device being released.

8. The piece of seating furniture according to claim 1, wherein the piece of seating furniture has a standing-up-aiding function, by which a seat surface can be raised, and wherein the blocking device is operatively coupled to the standing-up-aiding function such that the blocking device assumes a blocked state when the standing-up-aiding function is actuated.

9. The piece of seating furniture according to claim 1, wherein the piece of seating furniture has an operating lever for manual actuation, which can be used to switch the blocking device.

10. The piece of seating furniture according to claim 1, wherein the base-side bearing device is formed by the first one of the bearing devices with the encircling blocking surface, and the seat-unit-side bearing device is formed by the second one of the bearing devices with the at least one torsion spring.

11. A fitting for a piece of seating furniture comprising:

a base portion for fitting on a base of the piece of seating furniture;

a seat portion, on which to fit a seat unit of the piece of seating furniture; and a pivot bearing provided between the base portion and the seat portion, the pivot bearing comprising a base-side bearing device and a seat-unit-side bearing device, by which the seat portion can be rotated about a vertical axis in relation to the base portion;

the pivot bearing having a switchable blocking device, by which a rotary movement capability of the bearing devices in relation to one another can be blocked;

the blocking device comprising an encircling blocking surface on a first one of the bearing devices, at least one torsion spring which wraps around the blocking surface and is fastened on a second one of the bearing devices and has an internal diameter which is variable in dependence on a stressing state of the at least one torsion spring, and a switching device, by which the at least one torsion spring can be subjected to stressing and relieved of stressing;

wherein the at least one torsion spring, in a relieved-of-stressing state, butts against the blocking surface and thus prevents relative rotary movement between the bearing devices.

* * * * *